US008419267B1

(12) United States Patent
Melvin

(10) Patent No.: US 8,419,267 B1
(45) **Date of Patent: *Apr. 16, 2013**

(54) METHOD OF RESTRAINING AND LIFTING A CONTAINER

(71) Applicant: Edmund Waller Melvin, Pebble Beach, CA (US)

(72) Inventor: Edmund Waller Melvin, Pebble Beach, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/651,746

(22) Filed: Oct. 15, 2012

Related U.S. Application Data

(60) Continuation of application No. 11/686,816, filed on Mar. 15, 2007, now Pat. No. 8,287,181, which is a division of application No. 11/278,415, filed on Apr. 1, 2006, now Pat. No. 8,333,500.

(51) Int. Cl.
*B01F 13/00* (2006.01)

(52) U.S. Cl.
USPC ..... 366/348; 248/146; 248/163.1; 248/148; 366/129; 366/130; 366/349; 366/605

(58) Field of Classification Search ..... 248/148, 248/237, 317, 309.1, 310, 318, 346.01, 346.03; 366/129, 130, 204, 231, 233, 348, 349, 605; 220/737; 108/25, 33, 41, 51.11, 53.1; 206/486, 206/490, 506
See application file for complete search history.

(56) References Cited

U.S. PATENT DOCUMENTS 1,369,965 A * 3/1921 Comstock ..... 294/27.1
2,649,270 A * 8/1953 Franks ..... 248/311.2
3,099,355 A * 7/1963 Kane ..... 211/75
3,301,512 A * 1/1967 Nyberg ..... 248/524
3,871,651 A * 3/1975 Garcia et al. ..... 473/592
4,213,271 A * 7/1980 Petruzzi et al. ..... 47/39
4,633,536 A * 1/1987 Tribble-DuBose ..... 4/460
5,078,350 A * 1/1992 Zorichak ..... 248/148
5,232,187 A * 8/1993 O'Farrell et al. ..... 248/148
5,511,753 A * 4/1996 Lage ..... 248/238
5,564,345 A * 10/1996 Crawford et al. ..... 108/91
5,634,408 A * 6/1997 Jarkowski ..... 108/44
5,816,363 A * 10/1998 Searcy ..... 182/129
5,893,469 A * 4/1999 Nozawa ..... 211/71.01
6,209,487 B1 * 4/2001 Quinlan et al. ..... 119/51.01
6,361,001 B1 * 3/2002 Durand ..... 248/146
D463,159 S * 9/2002 Waggoner ..... D6/403
6,779,915 B2 * 8/2004 Foster, Jr. ..... 366/129
6,793,811 B1 * 9/2004 Fleischmann ..... 210/163
6,945,735 B1 * 9/2005 Doverspike ..... 405/184.4
7,018,528 B2 * 3/2006 Lee ..... 210/167.29
7,845,656 B2 * 12/2010 Thompson ..... 280/79.5

(Continued)

*Primary Examiner* — Todd M. Epps
(74) *Attorney, Agent, or Firm* — Stephen W. Melvin

(57) ABSTRACT

A one-piece stackable container restraining apparatus incorporates a flat surface and four legs. The restraining apparatus can be used on the crest of a roof or on other surfaces. The stackable feature is used to accommodate roofs of differing pitches and to create a more stable combination. In certain embodiments attachment holes are utilized for ease in transportation and movement. The attachment of the container to the flat surface allows one to lift a container along with the container restraining apparatus together by lifting only the container, for example by its handle. Additionally, the container restraining apparatus can be used on a flat surface to prevent overturning of the container during transportation, such as paint buckets transported in a truck or van. Mounting holes on each leg can be used to accommodate a variety of fixtures such as wheels or articulating pads.

8 Claims, 3 Drawing Sheets

U.S. PATENT DOCUMENTS 8,287,181 B1 * 10/2012 Melvin ..... 366/348
8,333,500 B1 * 12/2012 Melvin ..... 366/348
2010/0025077 A1 * 2/2010 Ujita ..... 174/153 G
2011/0290961 A1 * 12/2011 Kamon, II ..... 248/129
2012/0110903 A1 * 5/2012 Adams ..... 47/39

* cited by examiner

METHOD OF RESTRAINING AND LIFTING A CONTAINER

RELATED APPLICATIONS

This application is a continuation of U.S. patent application Ser. No. 11/686,816, filed on Mar. 15, 2007, now U.S. Pat. No. 8,287,181, issued on Oct. 16, 2012, which is a division of U.S. patent application Ser. No. 11/278,415, filed on Apr. 1, 2006, both of which are incorporated herein by reference.

FIELD OF THE INVENTION

This invention relates to the field of construction and home improvement, and more specifically to equipment for restraining containers of paint, sealant, other materials or tools.

BACKGROUND

It is sometimes necessary to apply paint or sealant while on an inclined roof or other surface. In these situations it is preferable to have an apparatus to hold the container containing the material being applied. Furthermore, it is more convenient and productive to apply paint or sealant directly from a five gallon bucket, rather than from a pan. Alternately, it is sometimes necessary to provide a container for tools and/or materials while working on an inclined roof or other surface. This requires a method of restraining a heavy bucket and current mechanisms for holding containers on inclined surfaces are limited.

A number of mechanisms have been proposed to hold paint cans or buckets on sloped roofs. For example, U.S. Pat. No. 4,962,906 discloses a paint can holder for supporting a can in an upright position on a sloped surface. This device can only accommodate a single can having a specific size of handle bosses. U.S. Pat. No. 5,217,193 also discloses a paint can holder for an inclined roof. This device requires manual adjustment for accommodating the slope of the roof. Similarly, U.S. Pat. No. 6,533,227 discloses an apparatus that attaches to a can and can be used to hold a can in an upright position if adjusted according to the slope of the roof. None of these three patents incorporate a flat level working surface. Such a surface is useful, for example, for striking a paint roller to reposition the roller on its handle (a frequent problem with paint rollers).

U.S. Pat. No. 5,249,397 discloses a platform that can be used to create a flat surface by manually adjusting the legs to accommodate the slope of the roof. This device does not restrain a can or bucket, but only creates a flat surface if properly adjusted. U.S. Pat. No. 5,558,306 discloses a platform incorporating a paint can holder for use on a sloped roof. This device requires manual adjustment according to the slope of the roof. U.S. Pat. No. 5,193,773 also discloses a bucket holding apparatus incorporating a device that attaches to the crest of a roof and a cable attached platform for holding a paint can. This device is complex and cumbersome to operate. It also does not have a flat level surface.

None of the six patents discussed in the preceding two paragraphs position a container above the crest of a roof or provide the simplicity of a single piece construction.

Accordingly, the need exists for an improved container restraining system that doesn't have the limitations of the mechanisms described above. What is needed is a simple and inexpensive apparatus for holding containers at the crest of a roof and also that can easily accommodate roofs of differing pitches.

BRIEF SUMMARY OF THE INVENTION

The present invention addresses the shortcomings described above by providing a simple stackable one-piece container restraining system incorporating a flat top surface and four legs. In one aspect of the present invention, a mechanism is provided to attach the container to the flat top surface of the apparatus. In another aspect of the present invention, mounting holes are provided on the legs to allow the attachment of various fixtures.

DETAILED DESCRIPTION

The restraining system of the present invention can be used on the crest of a roof and the apparatus can be stacked for stability and/or to accommodate roofs of differing pitches. This stacking feature can also elevate a large bucket of paint, tools, materials, etc to working height of one or more workers while standing on a flat level surface.

Figure 1:
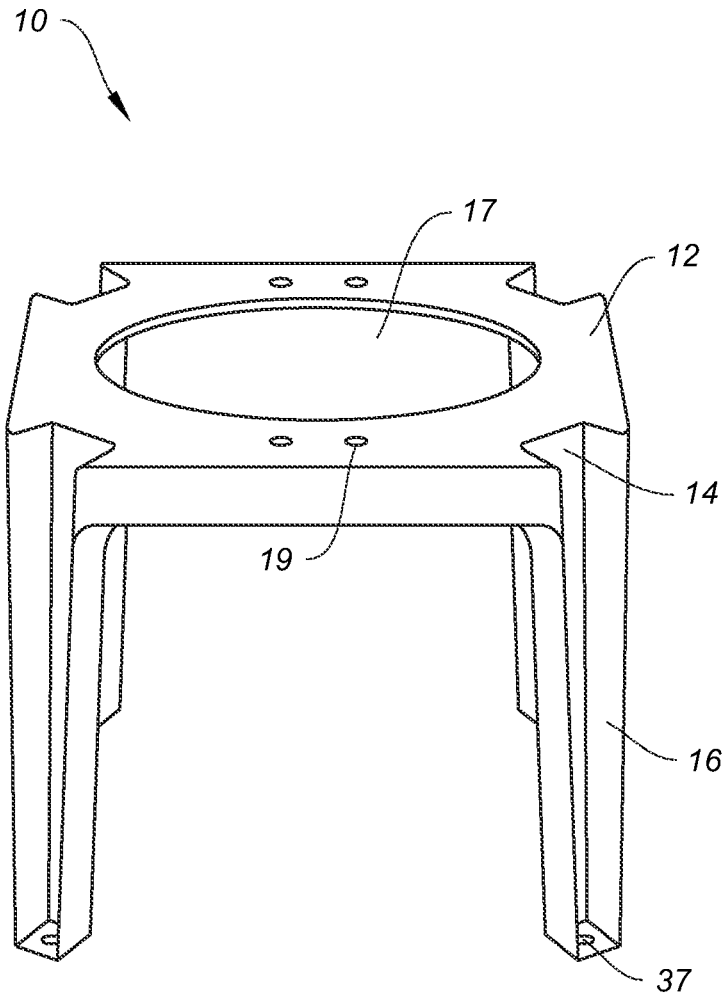
FIG. 1 illustrates an embodiment of the present invention.

FIG. 1 illustrates an embodiment of the present invention 10, in which top surface 12 is connected to four legs 16. Container restraining apparatus 10 has a hole 17 which is designed to accommodate a container of a specific size and shape. In a preferred embodiment hole 17 accommodates a standard size five gallon bucket, which has tapered sides and several exterior circumferential rings at the top. A standard five gallon bucket available in the United States measures approximately 10½ inches diameter at the bottom and approximately 11¾ inches diameter at the top. A hole of approximately 11 5/16 inches allows the tapered bucket to fit snugly in the restraining apparatus and the bucket will fit such that the flat surface 12 is at the level of the lowest ring 38. Those of skill in the art will appreciate that the present invention can be used with containers of other dimensions, and with either straight or tapered sides.

In one embodiment of the present invention, each leg 16 of container restraining apparatus 10 has a notch 14 which forms an indentation such that one instance of apparatus 10 can be stacked on top of another instance of apparatus 10. Those of skill in the art will appreciate that there are alternative designs having the stackable feature.

In one embodiment of the present invention, container restraining apparatus 10 also incorporates holes 19 which can be used to attach a container to the top surface 12. For example, a standard cable tie can be used through holes 19 and around the handle of the container. The attachment of the container to top surface 12 allows one to lift a container along with the container restraining apparatus 10 together by lifting only the container, for example by its handle. This permits easy movement of the container and restraining apparatus across the work surface. When several restraining apparatus 10 are stacked, alignment of holes 19 can be such that all apparatus in the stack are attached to the container to facilitate lifting the stack via the container handle. Alternately holes similar to 19 can be appropriately placed to accommodate attachment of quick-release locking devices to facilitate ease of attachment/detachment of apparatus 10 and bucket 24. It will be appreciated to those of skill in the art that alternative methods of attaching the container to the flat top surface 12 can be employed and fall within the scope of the invention.

In a preferred embodiment, each leg 16 has a mounting hole 37 at the foot of the leg for mounting of wheels, soft plastic/rubber inserts, articulating flat pads, spikes, or other devices for the purpose of providing mobility and/or to better accommodate a variety of work surface conditions. The mounting hole 37 of each leg can also be used to secure container restraining apparatus 10 to a flat surface such as a truck bed, plywood platform, etc. using standard bolts or screws.

Container restraining apparatus is preferably built from one piece of material, for example injection molded plastic. This method of manufacture permits the restraining apparatus to be inexpensively produced with high quality and consistent results. The apparatus of the present invention can be built by cutting a hole in an existing injection molded table, or an injection mold can be built that incorporates the hole. An example of a table into which a hole can be cut to manufacture the apparatus is illustrated in U.S. Design Pat. 335,980.

In a preferred embodiment the top surface 10 is substantially square, wherein the dimension between each pair of legs is substantially the same. In an alternative embodiment, restraining apparatus 10 is substantially rectangular in shape with one side longer than another. In this embodiment, the apparatus can be placed in two different orientations across the crest of a roof. Placing the apparatus such that the shorter dimension is across the crest of the roof allows for a greater clearance between the bottom of the container and the crest of the roof. This orientation may be necessary in highly pitched roofs. Alternatively, multiple apparatuses may be stacked to accommodate highly pitched roofs as discussed below.

Figure 2:
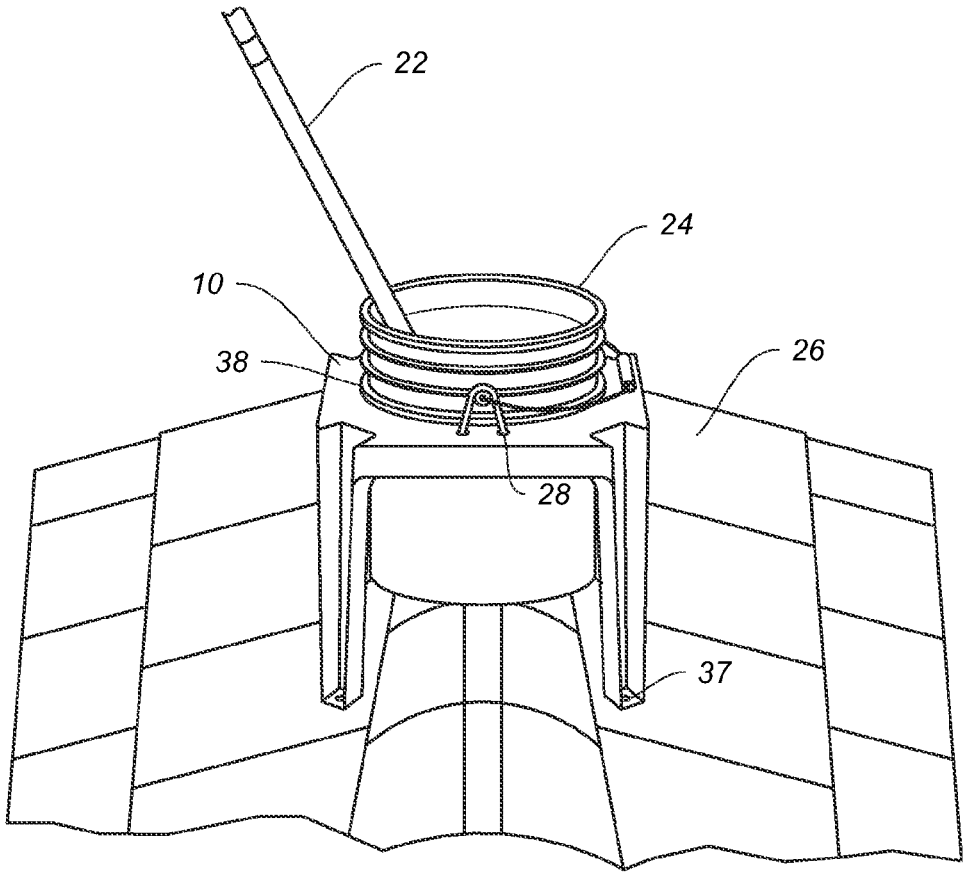
FIG. 2 illustrates an embodiment of the present invention with a bucket inserted therein and situated on the crest of a roof.

FIG. 2 illustrates an embodiment of the present invention situated on the crest of a roof. Container restraining apparatus 10 is situated on roof 26 and is holding five gallon bucket 24, which contains paint roller 22. FIG. 2 illustrates an attachment apparatus 28 that utilizes holes 19 to attach bucket 24 to the restraining apparatus if desired. In an alternative embodiment, restraining apparatus 10 can be fitted with either two or four wheels mounted under the legs. For example, two legs may have wheels and two legs may have articulating flat pads. The use of wheels permits the apparatus to be conveniently moved across the crest of the roof as work progresses. While FIG. 2 is shown in reference to the application of liquid material using a paint roller, the present invention can also be used to hold tools and materials. For example, an embodiment of the present invention can be used by roofers as a secure container for holding roofing tools, nails, staples, etc.

Figure 3:
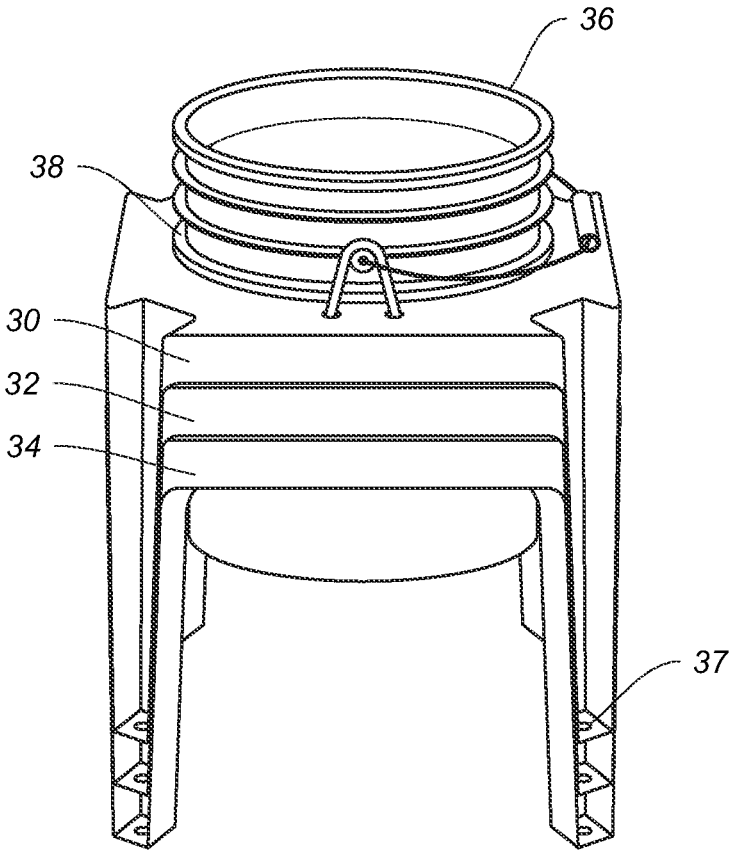
FIG. 3 illustrates three instances of an embodiment of the present invention stacked with a bucket inserted therein.

FIG. 3 illustrates the stackable feature of an embodiment of the present invention. Restraining apparatus 30 is stacked on top of apparatus 32 which is stacked on top of apparatus 34. Bucket 36 is inserted into the collective apparatus consisting of 30, 32 and 34. Stacking the restraining apparatuses 30, 32 and 34 accomplishes three important goals: first, it raises the height of the bottom of the container, allowing the combined apparatus to be used on a roof of high pitch, second, it creates a more stable combined apparatus due to the mutual reinforcement of the legs of each individual apparatus, and third, it provides for efficient storage of multiple restraining apparatuses.

An example of the use of the present invention involves a modification to a standard five gallon bucket to incorporate a valve at the bottom of the bucket. This modification may require the use of multiple stacked restraining apparatuses to elevate the height of the bucket to permit clearance of the valve. The valve and the position of the apparatus at the crest of a roof permits liquids contained in bucket 24 to be held at a position higher than the application surface. Thus, if bucket 24 is modified to accommodate such a valve, liquid materials to be distributed via application devices such as self loading paint rollers, brushes, mops, etc. can work more efficiently due to differential static pressure when the application device is operated closer to ground level than the level of fluid in bucket 24.

In one embodiment of the present invention, the flat top surface is substantially rectangular. In another embodiment of the present invention, the flat top surface is substantially circular.

Some embodiments of the present invention have a mounting hole at the bottom of each of the legs. In an embodiment of the present invention, two wheels are attached to two of the legs using two of the mounting holes. In another embodiment of the present invention, four wheels are attached to the four legs using the mounting holes. In another embodiment of the present invention, two articulating flat pads are attached to two of the legs using two of the mounting holes. In another embodiment of the present invention, four articulating flat pads are attached to the four legs using the mounting holes. In another embodiment of the present invention, two wheels are attached to two of the legs using two of the mounting holes, and two articulating flat pads are attached to two of the legs using two of the mounting holes.

The present invention has been described above in connection with several preferred embodiments. This has been done for purposes of illustration only, and variations of the inventions will be readily apparent to those skilled in the art and also fall within the scope of the invention.

The invention claimed is:

1. A method of restraining and lifting a container comprising the steps of:

providing a rigid five gallon container having a handle and a plurality of exterior circumferential rings, at least one of said exterior circumferential rings disposed on said container substantially below the top of said container;

providing an apparatus comprising a horizontal support member having a flat top surface with a through-hole provided for said container and four legs attached to said horizontal support member;

inserting said container into said apparatus;

attaching said container to said horizontal support member of said apparatus;

lifting said container and said apparatus together by lifting said container by said handle;

wherein said container extends through said horizontal support member and said at least one of said exterior circumferential rings makes contact with said flat top surface, fully supporting said container and its contents such that said container is suspended by said apparatus.

2. The method according to claim 1, wherein said step of attaching comprises attaching said container using holes provided in said flat top surface.

3. The method according to claim 1, wherein said step of attaching comprises attaching said container using a quick-release locking device.

4. The method according to claim 1 further comprising the steps of:

providing a second apparatus comprising a horizontal support member having a flat top surface with a through-hole provided for said container and four legs attached to said horizontal support member; and stacking said apparatus and said second apparatus, before said step of inserting.

5. The method according to claim 1 wherein said four legs each comprise a mounting hole at the bottom, and further comprising the step of:

securing said apparatus to a flat surface using said mounting holes.

6. The method according to claim 1 wherein said step of providing said apparatus comprises providing said apparatus constructed from one piece of material.

7. The method according to claim 6 wherein said step of providing said apparatus comprises providing said apparatus constructed with injection molded plastic.

8. The method according to claim 1 wherein said step of providing said apparatus comprises providing said apparatus having a flat top surface that is substantially square.

* * * * *